United States Patent [19]

Vandergriff et al.

[11] Patent Number: 4,999,881

[45] Date of Patent: Mar. 19, 1991

[54] CONDENSATE CONTROL APPARATUS FOR COTTON GIN CONDENSERS

[76] Inventors: A. L. Vandergriff, 719 N. Demaree, Visalia, Calif. 93291; Karl M. Smith, 1204 Dairy Ave., Corcoran, Calif. 93212

[21] Appl. No.: 441,995

[22] Filed: Nov. 28, 1989

Related U.S. Application Data

[63] Continuation-in-part of Ser. No. 414,197, Sep. 28, 1989.

[51] Int. Cl.[5] ..... D01B 1/06

[52] U.S. Cl. ..... 19/48 R; 19/66 R; 55/269

[58] Field of Search ..... 19/48 R, 66 R; 55/269, 55/290, 291; 65/5, 27

[56] References Cited

U.S. PATENT DOCUMENTS

| | | | |
|---|---|---|---|
| 1,971,124 | 8/1934 | Tudor et al. | 19/66 R |
| 1,973,761 | 9/1934 | Hill | 19/66 R |
| 2,214,497 | 9/1946 | Calhoun | 19/48 R |
| 2,373,768 | 4/1954 | McCreery | 19/66 R |
| 2,761,178 | 9/1956 | Van Doorn et al. | 19/48 R |
| 3,391,428 | 7/1968 | Whitehurst | 19/66 R |
| 3,925,849 | 12/1975 | Griffin, Jr. et al. | 19/48 R |
| 4,140,503 | 2/1979 | Vandergriff | 19/66 R X |

FOREIGN PATENT DOCUMENTS

| | | | |
|---|---|---|---|
| 1219682 | 3/1986 | U.S.S.R. | 19/48 R |

*Primary Examiner*—Werner H. Schroeder
*Assistant Examiner*—John J. Calvers
*Attorney, Agent, or Firm*—Jennings, Carter, Thompson & Veal

[57] ABSTRACT

A condensate control apparatus for receiving drum type condenser units utilized in cotton ginning which eliminates moisture buildup on predetermined metal surfaces within the condenser unit by heating such surfaces with heated dry air emanating from a heat source and conducted to such surfaces through a series of heating ducts. The condensate control apparatus also compacts the cotton gin fiber collected by such condensers into batts wherein the compacting force utilized in combination with moisturized air integrated within the cotton is sufficient to overcome the cottons inherent resiliency thereby permanently reducing the volume per unit weight of such cotton batts.

18 Claims, 3 Drawing Sheets

CONDENSATE CONTROL APPARATUS FOR COTTON GIN CONDENSERS

This is a continuation in-part of U.S. Ser. No. 414,197, filed Sept. 28, 1989.

FIELD OF THE INVENTION

The present invention relates to cotton ginning equipment and more particularly to revolving drum type condenser units utilized in cotton ginning. In even greater particularity, the present invention relates to an improvement which eliminates moisture build-up within such condensers. In even greater particularity, the present invention relates to a means of heating predetermined surfaces within the condenser unit utilizing heated air. This invention further relates to compressing a moisturized cotton batt to increase its density.

BACKGROUND OF THE INVENTION

The use of revolving drum type condensing units to accumulate cotton lint and to compact the fibers into a more manageable form is a very common practice in the cotton ginning industry. The use of warm humidified air is also used to create an increased moisture level within the confines of the condenser units. The added humidity also increases the efficiency of compaction of these fibers into cotton bales. Textile producers prefer the cotton delivered at approximately an 8% humidity level in order for the cotton to be at an optimum condition for processing in the textile mills.

However, the use of humidified air to increase the moisture level of the cotton fiber creates an additional problem. Not all the humidity is absorbed by the cotton fiber. A substantial amount of the vapor accumulates as condensation on the metal surfaces within the condenser unit. This condensation causes the cotton fiber to adhere to these surfaces, thus accumulations of short fiber and dust block the air flow and hinder the movement of the cotton lint from the condenser unit to the baling press.

Illustrative of the prior art is U.S. Pat. No. 4,140,503, wherein the process of compacting lint begins with the lint fibers entrance into the condenser housing. The arcuate condenser housing converges toward a rotating surface of a perforated drum in the direction of drum rotation. The lint is transported by an air current created by a blower or fan.

The drum is open on at least one end with its cylindrical surface being a screen or perforated material of sufficient grade to prevent the passage of lint fiber into the drum. Air current passes into the drum as a result of a pressure differential created within the drum by the blower or fan which is connected to a discharge duct. The drum rotates about a drum axis and as the air current passes within the drum, the lint fiber carried by such current collects on the surface of the drum.

The rotation of the drum delivers the collected lint to an area within the condenser housing containing a humidifying vent which integrates moisture into the hygroscopic lint as explained in U.S. Pat. No. 4,140,503. The continued rotation of the drum delivers the humidified lint fiber to a doffing chamber. As the lint fiber enters the doffing chamber, a driven first doffing roller compacts the lint fiber against the surface of the vacuum drum forming a sheet of compacted lint fiber hereinafter referred to as a lint batt.

A second doffing roller is located tangent the vacuum drum and is driven in the same rotational direction as the drum. The second doffing roller is equipped with several semi-rigid doffing fins which radially extend from the second doffing roller and displace the lint batt from the drum. The rotation of the second doffing roller directs the lint batt between a pair of driven sealing rollers. A first sealing roller is driven rotationally contrary to the second sealing roller. The doffing chamber is isolated from the outside environment by a combination of the lint batt, the sealing rollers, an upper separating wall and a lower separating wall that join the condenser main housing. An upper sealing gasket and a lower sealing gasket extend from the separating walls to the sealing rollers, forming a seal between the separating walls and the sealing rollers.

Problems occur when, as a result of the humidified air and lint fiber, moisture begins to condense on the drum, separating walls, the sealing rollers, the doffing rollers and the lint slide. The moisture build-up tends to cause the lint fibers to adhere to these surfaces thereby causing blockages and disturbing the integrity of the compacted lint batt.

As the cotton fibers are accumulated, they are fed between the sealing rollers which are slightly biased toward each other by a pair of springs, normally about 50 lb. springs. The biased rollers apply pressure to the moist lint fibers as they are discharged from the condenser, thereby maintaining an air seal while adjusting to varying batt thicknesses. However, if this compacting pressure could be increased at the condensing stage subsequent to increasing the moisture level, when the batt of cotton fiber is relatively thin, the volume of the batt would be reduced, making it easier to alter the flow from one press to another without sustaining substantial back-up in the flow of cotton. Also, the amount of pressure required to bale the cotton with a baling press would be reduced.

SUMMARY OF THE INVENTION

It is an object of this invention to provide a means for reducing accumulated moisture from predetermined components of drum type condenser units, to reduce down time and to allow higher amounts of moisture addition without operational problems.

Another object of this invention is to employ the heat source, currently utilized to vaporize water droplets in the air that moisturizes the cotton in drum type condenser units, as a heat source for producing heated air for removing such accumulated moisture.

These objectives are accomplished by a system of air chambers and conduits which convey dry heated air to predetermined metal surfaces within the condenser unit thereby increasing the temperature of the surfaces and eliminating the moisture build-up on these surfaces.

Our invention utilizes a dry air discharge conduit connected to the condenser unit's heat source. This heat source is usually employed to vaporize moisture droplets into heated air which is later blown through the accumulated cotton fiber. The hot air discharge conduit is an air duct designed to transfer hot air, generated by the heat source, to a lint slide heat exchange chamber. The lint slide heat exchange chamber is comprised of four enclosing surfaces. The upper surface is the lint slide itself. The lint slide is a smooth, downwardly sloping plane of metal originating at the discharge point of the condenser unit and ending at the baling press. The purpose of the lint slide is to provide a smooth surface for a batt of compacted cotton fiber to gravitationally travel from the condenser unit to the baling press, and is of sufficient length to hold the batt that accumulates during the time the baling press must be stopped for each baling operation.

As the hot air enters the lint slide heat exchange chamber, a portion of the heat is transferred to the lint slide increasing the temperature thereof. This increase in temperature causes any moisture deposited on the lint slide by the moist batt of cotton to evaporate, thereby preventing the build-up of fibers on the lint slide surface and reducing the friction between the cotton batt and the lint slide.

Heated air is also transferred into first and second heat exchange chambers which are partially defined by walls defining portions of the doffing chamber of the condenser unit. The heated air reduces condensation on the doffing chamber walls by conduction and is vented onto sealing rollers included within the doffing chamber thereby reducing moisture accumulation on these rollers. Heated air from the heat exchange chambers is also vented onto moist compacted cotton fiber being discharged from the condenser unit. The temperature of the hot air is controlled independently of the moist hot air by a thermostat in the hot air ductwork following an air mixing valve that responds to the thermostat to change the amount of ambient air that is mixed with the hot air from the heat source.

Yet another object of this invention is to reduce the volume of the cotton batt. The combination of adding moisture to the cotton before it reaches the heavy compression of the sealing rollers and the increased compression these rollers exert will overcome the natural resiliency of the batt, wherein the batt remains compressed as it is fed into the conventional pre-pressing part of a press where a vertically reciprocating tramper presses individual charges into the baling bed. The volume that the cotton occupies limits the weight of the cotton which can be fed to the press in a given time. By reducing the volume the present invention greatly increases the rate at which cotton may be charged to the press or reduces the rate at which the press must operate to charge the same weight.

As mentioned previously, the purpose of the vent slots is to direct heated dry air onto the sealing rollers keeping the rollers free from moisture and lint fiber build-up. The sealing rollers maintain heavy pressure on the cotton fibers as they are discharged from the doffing chamber. The second sealing roller is biased toward the first sealing roller by two fluid-pressure operated piston and shaft assemblies which substantially increases the amount of pressure applied by prior condenser units to the cotton fibers as they are discharged from the doffing chamber, greatly diminishing the amount of pressure subsequently required by the baling press to form the sheets of cotton into bales.

BRIEF DESCRIPTION OF THE DRAWINGS

Apparatus embodying features of our invention are illustrated in the accompanying drawings which form a portion of this disclosure and wherein.

DESCRIPTION OF THE PREFERRED EMBODIMENT

Figure 1:
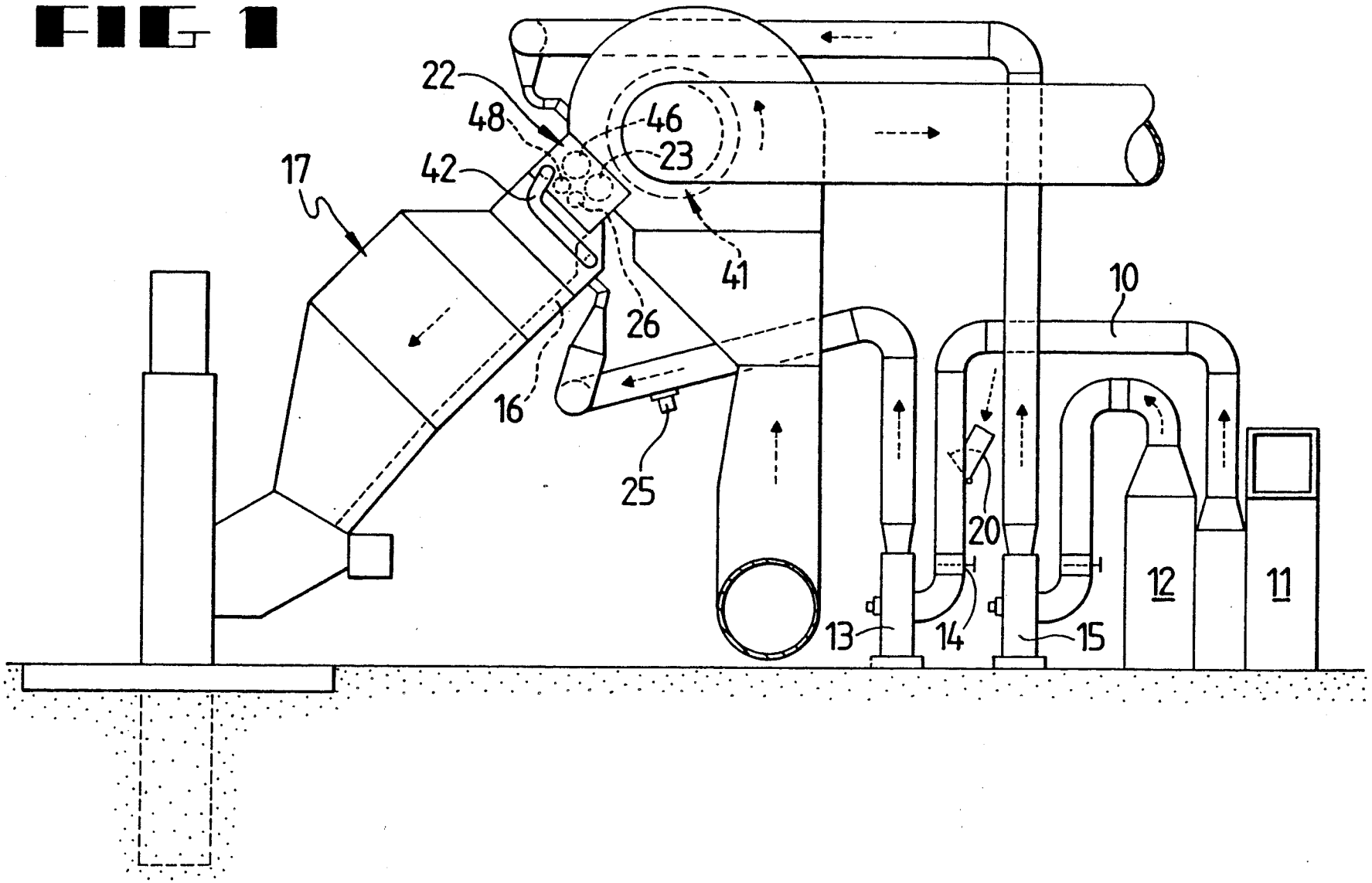
FIG. 1 is a side elevational schematic view of a condenser unit and associated air heating and humidifying apparatus.

A clearer understanding of our invention may be had from a study of the attached drawings. With reference to FIG. 1, which is an overall side perspective of a typical layout embodying our invention, it may be seen that the present invention utilizes a heat source to supply a quantity of heated air through a duct work system to the drum type condenser housing. The heat source may be any convenient heat source which will allow the air to be heated to a usable temperature, that is to a temperature at which moisture which has condensed on interior surfaces of the condenser housing can be eliminated. With this in mind, it is clear that super heated steam could be used as the heated air or a hot dry air could be used as the heated air. In the embodiment shown, a heater element 11 is utilized to provide heated dry air at an outlet which is bifurcated with one portion of the heated dry air going through a humidifying element 12 such as is described in U.S. Pat. No. 4,140,503 referred to hereinabove. The humidified air exiting humidifying element 12 is directed through a fan unit 15 to the condenser housing where the steam is directed through a batt of cotton collected on the rotary condenser drum 41 as is conventionally known. It will be understood that if superheated steam were utilized, then the temperature of the steam in the duct work between the heating element 11 and the rotary drum condenser could be adjusted to provide the required humidity which would be given up to the cotton. The remainder of the output of the heater unit 11 is directed to a second fan 13 and through a second duct work to the output side of the rotary drum type condenser. Intermediate the heat source 11 and the fan 13 is a vent 20 through which ambient air may be drawn into the ductwork to control the temperature of the heated air being introduced by this system in accordance with a predetermined temperature required to insure that condensation in the system is controlled. The proper temperature is sensed by a thermostat or other suitable sensor 25 located downstream of the fan 13.

Figure 2:
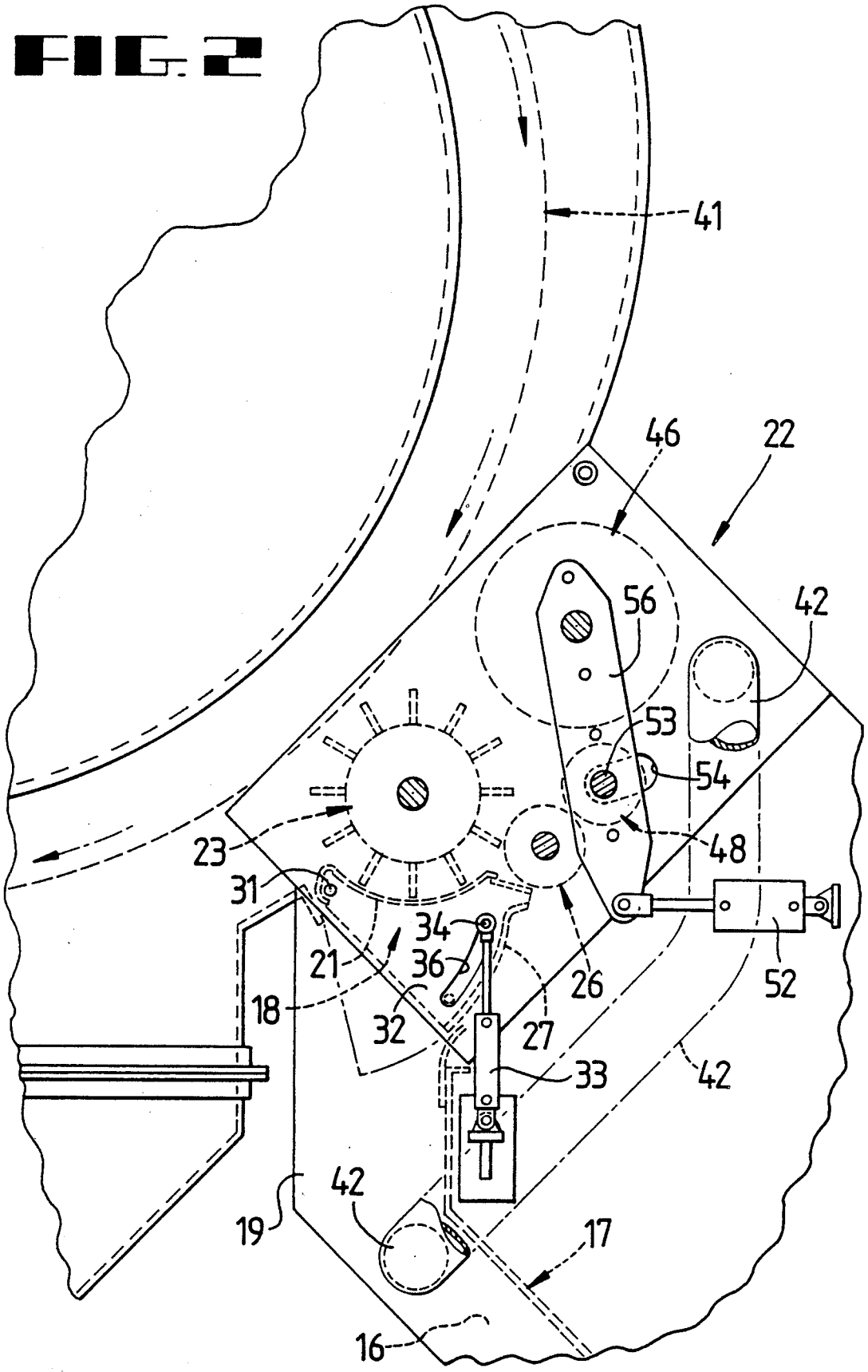
FIG. 2 is an enlarged side elevational view of our condenser unit's doffing chamber housing, specifically illustrating the fluid pressure operated piston and shaft assemblies and their relation to the lower separating wall and the second sealing roller.
Figure 3:
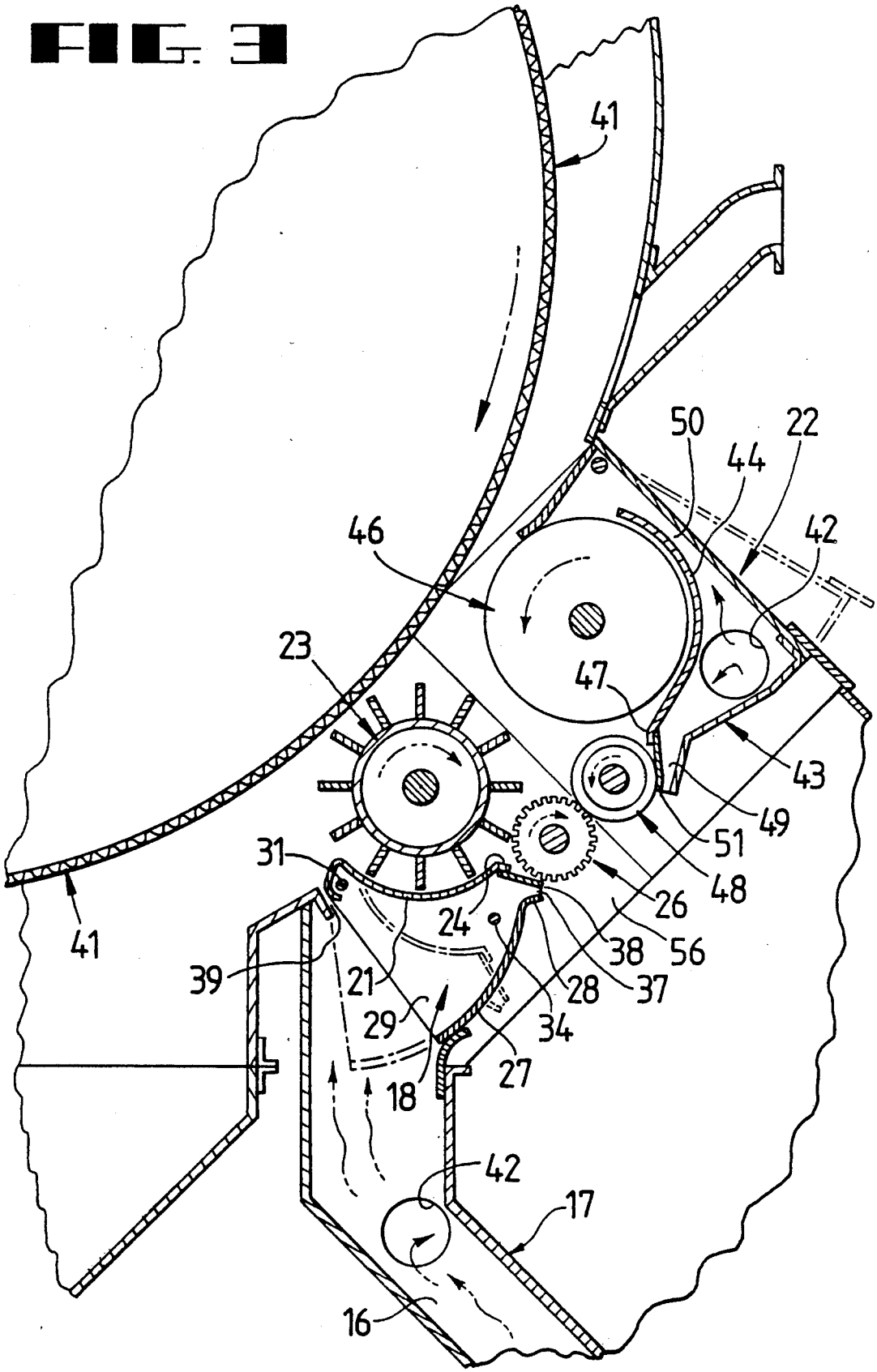
FIG. 3 is an enlarged sectional side view of a condenser unit's doffing chamber housing, specifically illustrating the doffing chamber, the heat exchange chambers and the lint slide chamber.

As shown in FIG. 2, the heated air flows into a plenum or first heat exchange chamber 18 which communicates with the hot air duct work 19. The first heat exchange chamber 18 is a semi-enclosed volume which is partially defined by an upper separating wall 21, which also partially defines a doffing chamber 22. The upper separating wall 21 circumscribes a lower doffing roller 23 and has a first upper margin 24 located proximal a first sealing roller 26 when the chamber is in an operating position as shown in FIG. 3. As heated air flows through the first heat exchange chamber 18, heat is transferred to the upper separating wall 21, thereby reducing any moisture accumulation on the doffing chamber side of the upper separating wall 21. The first heat exchange chamber 18 is further defined by a scrolling wall 27 located opposite the upper separating wall 21 extending in an outwardly curving arc from a second upper margin 28 located parallel to but spaced away from the first upper margin 24 of the upper separating wall 21. The upper separating wall 21 and the scrolling wall 27 are connected at their laterally extended edges by two chamber panels 29 which further define the enclosed space of the first heat exchange chamber 18. The bottom of the first heat exchange chamber 18 is open and communicates with a lint slide chamber 16 when the first heat exchange chamber 18 is in an operating position. The first heat exchange chamber 18 is pivotally mounted beneath the doffing chamber 14 on a pair of extension axles 31 which extend from each chamber panel 29 through the side panel 32 of the condenser unit. As shown in FIG. 2, the extension axles 31 are located on the chamber panels 29 at a point defined as the axial centerpoint of the arc defined by the curvature of the scrolling wall 27. When the condenser unit is not in operation the first heat exchange chamber 18 can be downwardly pivoted from its operating position below the doffing chamber 22 to a cleaning position partially within the lint slide chamber 16 as shown in FIG. 3.

The first heat exchange chamber 18 is pivoted from the operating position to the cleaning position by a first fluid-operated piston and shaft assembly 33 which is pivotally connected to the first heat exchange chamber 18 by a connection joint which extends from the chamber panel 29 through a first guide slot 36 which is defined within the side panel 32. Pivoting the first heat exchange chamber to the cleaning position when the condenser unit is not in operation permits access of the doffing chamber 22 and the internal components therein.

The heated air flows out of the first heat exchange chamber 18 through a first vent slot 37 defined by the first upper margin 24 of the upper separating wall 21 and the second upper margin 28 of the scrolling wall 27 and located below and parallel to the first sealing roller 26 when the first heat exchange chamber 18 is in the operating position. The air discharged from the first vent slot 37 blows onto the first sealing roller 26 reducing moisture build-up and removing adhering lint fiber which may cling to the first sealing roller 26 and wedge between the first sealing roller 26 and a lower seal 38. The lower seal 38 is a semi-flexible strip of material that laterally extends the distance of the separating wall 21 being positioned adjacent to the first vent slot 37. The lower seal 38 extends away from the separating wall 21 and contacts the rotatably driven surface of the first sealing roller 26 when the separating wall 21 is in an operating position. The lower seal 38 helps segregate the heated air being discharged from the first heat exchange chamber 18 from moist air being injected within the condenser unit.

A lower auxiliary vent 39 extending parallel to the lower doffing roller 23 is formed in the area of the pivot of the first heat exchange chamber to allow heated dry air to flow onto the lower doffing roller 23 and the condenser drum 41, thereby reducing moisture and cotton fiber accumulation thereon.

A transfer conduit 42 is connected to and discharges heated dry air into a second heat exchange chamber 43. The second heat exchange chamber 43 is a semi-enclosed volume which is partially defined by a lower separating wall 44, which also partially defines the doffing chamber 22. The separating wall 44 circumscribes an upper doffing roller 46 and has a lower edge 47 proximal a second sealing roller 48. As heated air flows through the second heat exchange chamber 43, heat transfers to the separating wall 44, reducing any moisture accumulation on the doffing chamber side of the separating wall 44.

The heated air flows out of the second heat exchange chamber 43 through a second vent slot 49 defined therein, located just above and extending parallel to the second sealing roller 48. The air discharged from the second vent slot 49 blows on the second sealing roller 48 reducing moisture accumulation and removing adhering lint fiber which may cling to the second sealing roller 48 and wedge between the second sealing roller 48 and an upper seal 51. The upper seal 51 extends away from the lower separating wall 44 and contacts the rotatably driven surface of the second sealing roller 48. The upper seal 51 helps segregate the dry air being discharged from the second heat exchange chamber 43 from moist air being injected within the condenser unit. The entire upper assembly including the roller and the plenum may be pivotally mounted to facilitate cleaning.

Heated dry air also flows out of the second heat exchange chamber 43 through an upper auxiliary vent 50 located above and extending parallel to the second doffing roller 46. The air discharged from the auxiliary vent 50 blows on the second doffing roller 46 reducing condensate accumulation and removing adhering lint fiber.

The second sealing roller 48 is biased toward the first sealing roller 26 by a pair of second fluid operated piston and shaft assemblies 52 located on the exterior side panels 32, as shown in FIGS. 2 and 3 (a piston and shaft assembly 52' and a second side panel 32' are not shown for the sake of clarity). The second sealing roller 48 rotates on a driven axis 53 which extends through a pair of second guide slots 54 defined within the side panels 32. Each extended end of the driven axis 53 is rotatably secured to a lever arm 56 which is pivotally secured on one end to the exterior of the side panel 32 and is pivotally secured on the other end to the second piston and shaft assembly 52. Each second piston and shaft assembly 52 is pivotally connected to the exterior of side panel 32. In a prototype of the apparatus each assembly 52 used a 3 inch cylinder at 30 psi to apply a total force of 424 pounds to the sealing roller 48 which was approximately 56 inches in length, thus slightly more than 7 pounds of force per linear inch was applied to the cotton.

The lint slide chamber 16 is formed by the lint slide 17 and a plurality of walls depending therefrom so as to form a secondary plenum communicating with the first heat exchange chamber such that a portion of the air directed to the first heat exchange chamber by the hot air ductwork is circulated through the lint slide chamber thereby heating the lint slide to reduce the amount of moisture which may accumulate on the surface of the lint slide adjacent the moving cotton batt. The lint slide may be open at the bottom thereof to vent air therethrough or the lint slide and the first and second heat exchange chambers may have provision made for returning unvented air to the heater element 11.

As previously mentioned, heated dry air is vented on the rotating condenser drum 41 subsequent to its contact with the second doffing roller 46. The result of this venting action is a reduction of moisture on the condenser drum 41 which in turn reduces the amount of cotton fiber accumulation thereon. The problem with having accumulation of cotton fiber on the condenser drum 41 is that the fibers may wedge between the drum 41 and the walls of the doffing chamber 22 adjacent which the vacuum drum 41 passes as it exits the doffing chamber 22. The cotton fiber accumulation multiplies as the drum 41 continually rotates and may interfere with the movement of the cotton batt through the doffing chamber 22. Also a continuous build-up or hairing over of cotton fiber on the condenser drum 41 reduces the amount of air flow entering the condenser drum 41, thereby reducing the efficiency of the condenser unit in collecting the individual cotton fibers into a bat thereon. That heated air which flows onto the condenser drum 41 from the lower auxiliary vent 39 reduces this accumulation by reducing moisture build-up on the drum 41. This same type of cotton fiber accumulation is reduced on the doffing rollers and sealing rollers by the aforementioned flow of heated dry air onto such surfaces.

The foregoing description of the apparatus illustrates two aspects of the invention which are combined herein in a novel manner to facilitate the handling of the cotton fiber and batt as it is formed in the rotary drum type condenser. In operation the cotton fibers which are typically reduced in moisture content by the ginning process to a level of about 2–4% are entrained in an air flow and carried to the condenser drum whereupon they are formed into a batt. The cotton fiber at this moisture content has a great deal of inherent natural resiliency and is not readily compressed into a batt which will remain compressed, which is a problem noted in the prior art not only in the condensing process but also in the baling process. As noted hereinabove the prior art recommended the introduction of moisture to the condensing process to make the cotton easier to handle and to improve the baling characteristics of the cotton in as much as cotton which has an increased moisture content more readily retains its compacted state after compression. It is believed that a moisture level of at least 6% or thereabouts is required to provide a mass of cotton or batt which will retain its compacted shape. Therefore the prior art has suggested means for moisturizing or enhancing the moisture content of the cotton fiber. This created certain problems with the build-up of moisture within the condenser which are solved in the instant invention through the use of heated air, either dry air or superheated steam, which eliminates the moisture build-up and allows the cotton to move more readily and through the condenser unit. However, the elimination of moisture build-up in the condenser housing is only a partial solution to the more effective processing of the cotton fibers. Therefore, after the cotton has been moisturized and the excess moisture controlled, the present invention combines therewith the additional step of providing a compression on the batt as it exits the condenser drum to compress the cotton fibers in a manner which has not heretofore been done, i.e. the batt itself is compressed before it enters the baling chamber. While the present illustrations show a construction wherein the doffing chamber includes a set of doffing rollers and a set of sealing rollers it will be understood that in certain embodiments the sealing rollers are not necessary and the only rollers present are the doffing rollers. In such an instance the principals described herein are still applicable in that the moisture content of the cotton fiber is raised to a desired level, preferably about 8% but at least 6% by weight and the batt as it is being formed is compressed to overcome the natural resiliency of the cotton batt. Typically these batts will be compressed to a thickness of less than one-half their uncompressed thickness which in the prototype described herein, required an application of force of slightly greater than 7 pounds per linear inch of compression roller.

When the cotton has been thusly moisturized and compressed in accordance with the present invention, its handling characteristics are greatly improved and the prevention of moisture accumulation in the condenser allows the compressed batt to proceed down the lint slide to the baling chamber without undue friction or disruption of the batt integrity. Thus the reduced volume batt may be placed in the baling chamber and compacted with much less force required from the tramper ram in as much as the density of the batt has already been increased due to the compaction of the moisturized cotton by the rollers of the present invention.

It should also be understood that the present invention also improves the handling and transfer characteristics in condensers wherein it is not necessary to introduce moisture to the cotton. That is to say, directing heated air to the surfaces as described above will have beneficial effects even without adding moisture to the cotton.

While we have shown our invention in one form, it will be obvious to those skilled in the art that it is not so limited but is susceptible of various changes and modifications without departing from the spirit thereof.

What we claim is:

1. Apparatus for preventing the accumulation of moisture on cotton fiber transfer surfaces of a rotary drum condenser for cotton fibers wherein said rotary drum condenser is supplied with humidified air, comprising a plenum disposed proximal a set of parallel rollers through which cotton fiber is removed from a rotary drum and being defined by at least one wall proximal one roller of said set of rollers, said one wall being conductive to heat transfer, said plenum defining at least one outlet slot to direct heated air onto at least one roller of said set of rollers; and means for providing heated air to said plenum such that heat is transferred through said wall to reduce moisture condensation thereon and such that said heated air is forced through said slot.

2. Apparatus as defined in claim wherein said plenum communicates with a secondary plenum subjacent a lint slide positioned proximal said set of parallel rollers to receive cotton fiber passing therethrough.

3. Apparatus as defined in claim 1 wherein said plenum defines a secondary slot intermediate said one roller and said rotary drum such that heated air is directed therethrough onto said rotary drum.

4. Apparatus as defined in claim 1 wherein said one wall partially defines a doffing chamber, said set of parallel rollers are sealing rollers defining an outlet for said doffing chamber, and further comprising a set of doffing rollers positioned within said doffing chamber to remove said cotton fiber from said rotary drum, said one wall partially circumscribing one roller of said set of doffing rollers.

5. Apparatus as defined in claim 4 wherein one roller of said set of sealing rollers is movable generally radially relative to the other roller of said set and further comprising means for urging said one roller toward said other sealing roller to compress said cotton fibers passing therethrough to compress moisturized cotton into a compacted batt.

6. Apparatus as defined in claim 1 wherein said means for urging comprises a pair of linear actuators mounted to the ends of said one sealing roller substantially perpendicular thereto and adapted to urge said one sealing roller toward the other sealing roller.

7. Apparatus as defined in claim 3 wherein said plenum is pivotally mounted proximal said secondary slot for movement of said one wall away from said one roller.

8. Apparatus as defined in claim 1 wherein said means for providing heated air comprises a heater unit having a bifurcated output of heated dry air with a portion of said output directed to said plenum and the remainder of said output directed to a humidifier for introduction to an associated condenser to raise the moisture content of cotton fiber processed therein to a predetermined level and means for providing forced air flow to said plenum.

9. Apparatus as defined in claim 1 wherein said means for providing comprises a source of pressurized steam and means for providing forced flow of said steam to said plenum.

10. Apparatus as defined in claim 8 further comprises an ambient air vent for selectively introducing ambient air to said air flow means to control the temperature of said heated air and means responsive to the temperature of said air at said plenum to control the amount of said ambient air introduced via said vent.

11. A method of processing cotton fibers utilizing a rotary drum condenser system wherein cotton fibers are transported to a rotary drum condenser by air currents and are removed therefrom by a set of doffing rollers comprising the steps of:

(a) establishing a moisture content in said cotton fibers of at least a predetermined level;

(b) compressing a batt of the fibers removed by said doffing roller sufficiently to overcome the natural resiliency of said batt such said batt remains substantially denser after compression (c) directing heated air to cotton transfer surfaces within said condenser system to reduce moisture condensation thereon.

12. The method as defined in claim 11 wherein said moisture content is at least about 6% by weight.

13. The method as defined in claim 11 wherein said moisture content is about 8% by weight.

14. The method as defined in claim 13 wherein said batt is compressed to less than one-half its uncompressed thickness.

15. The method as defined in claim 13 wherein said batt is compressed between a set of driven rollers with said rollers applying a force of at least 6 lbs. per linear inch along said roller.

16. The method as defined in claim 13 wherein said moisture content is established by directing steam into said cotton fibers.

17. The method as defined in claim 11 wherein heated dry air is passed through a humidifier and then through said cotton fibers to give up moisture thereto.

18. Apparatus for preventing the accumulation of moisture on cotton fiber transfer surfaces of a rotary drum condenser for cotton fibers, comprising a plenum disposed proximal a set of parallel rollers through which cotton fiber is removed from a rotary drum and being defined by at least one wall proximal one roller of said set of rollers, said plenum defining at least one outlet slot to direct air onto at least one roller of said set of rollers; and means for providing air to said plenum such that air is forced through said slot.

* * * * *